US008022323B2

(12) United States Patent
Watada et al.

(10) Patent No.: US 8,022,323 B2
(45) Date of Patent: Sep. 20, 2011

(54) SWITCH APPARATUS

(75) Inventors: Tsutomu Watada, Tokyo (JP); Masanori Endo, Tokyo (JP)

(73) Assignee: Niles Co., Ltd., Tokyo (JP)

( * ) Notice: Subject to any disclaimer, the term of this patent is extended or adjusted under 35 U.S.C. 154(b) by 434 days.

(21) Appl. No.: 12/289,874

(22) Filed: Nov. 6, 2008

(65) Prior Publication Data

US 2009/0127080 A1 May 21, 2009

(30) Foreign Application Priority Data

Nov. 15, 2007 (JP) ..... 2007-296490

(51) Int. Cl.
*H01H 13/06* (2006.01)

(52) U.S. Cl. ..... 200/302.2

(58) Field of Classification Search ..... 200/302.2, 200/334, 61.69, 81 R, 83 J, 83 S, 82 C
See application file for complete search history.

(56) References Cited

U.S. PATENT DOCUMENTS

| | | | | |
|---|---|---|---|---|
| 3,043,929 | A * | 7/1962 | Guthrie | 200/83 J |
| 4,827,095 | A * | 5/1989 | Clark et al. | 200/83 J |
| 4,900,883 | A * | 2/1990 | Brame et al. | 200/83 S |
| 4,933,517 | A * | 6/1990 | Yogo | 200/83 J |
| 5,237,136 | A * | 8/1993 | Langston | 200/81 R |

FOREIGN PATENT DOCUMENTS

| | | |
|---|---|---|
| JP | 09-265859 | 10/1997 |
| JP | 2006-29579 | 2/2006 |

* cited by examiner

*Primary Examiner* — Edwin A. Leon
(74) *Attorney, Agent, or Firm* — Rader, Fishman & Grauer PLLC

(57) ABSTRACT

The present invention aims at achieving the object of keeping a contact housing portion liquid tight sealed and to improve the durability of a switch apparatus. A switch apparatus according to the present embodiment includes: a switch case 3 including a contact housing portion 25 therein and a shaft hole 27; a rod 5 whose outer flange portion 33 is capable of axially abutting on and engaging with a periphery portion 121*a* of a detecting plate; a first return spring 37 biasing the rod 5 in the direction opposite to protruding direction; a fixed contact 9 in the switch case 3 and a movable contact 7 which can reciprocally move between a position touching the fixed contact 9 and a non-touching position; a diaphragm 11 separating the shaft hole 27 from the contact housing portion 25 and being formed of rubber; a movable base 39 supporting the movable contact 7 and abutting on the diaphragm 11; a second return spring 2 bringing the movable contact 7 into contact with the fixed contact 9; and a retention member 13 interposed between the diaphragm 11 and the rod 5, including an abutting portion 41 for abutting on the rod 5, and axially movably, but not rotatably supported with respect to the switch case 3.

3 Claims, 2 Drawing Sheets

SWITCH APPARATUS

BACKGROUND OF THE INVENTION

1. Field of the Invention

The present invention relates to a switch apparatus used for detecting a differential lock state in an automobile.

2. Description of the Related Art

Hitherto, there has been known a switch apparatus capable of detecting a locking state or an unlocking state of a differential apparatus, as illustrated in FIG. 3 (refer to Patent Document 1). FIG. 3 illustrates a cross section of a rear differential apparatus for an automobile.

The rear differential apparatus 101 illustrated in FIG. 3 includes a locking device which locks a differential mechanism 111 such that a lock member 105 supported by a differential case 103 moves in the axial direction and engages a side gear 107 with a dog clutch 109.

A differential lock state is detected by a switch apparatus 115 supported on the side of a differential carrier 113.

The switch apparatus 115 is equipped with a rod 117 for detection. A flange 119 of the rod 117 is capable of axially engaging with the periphery of a detecting plate 121 attached to the lock member 105.

For this reason, when the lock member 105 moves to lock the differential mechanism, the flange 119 engages with the periphery of the detecting plate 121 in the axial direction and draws the rod 117 out in the axial direction.

The movement of the rod 117 in the axial direction enables the switch apparatus 115 to detect the differential lock state.

The structure of the switch apparatus 115 is illustrated in a cross section in FIG. 4 and is the same as that described in Patent Document 2.

As illustrated in FIG. 4, the switch apparatus 115 has a contact housing portion 125 in a switch case 123 and a shaft hole 127 opened to outside at one end thereof.

The rod 117 is movably supported in the axial direction along the shaft hole 127 and biased by a return spring 129, which is disposed between the rod 117 and the switch case 123, toward the contact housing portion 125.

A movable contact 131 is disposed at the inner end of the rod 117 and opposes axially to a fixed contact 133 which is provided on the side of the switch case 123.

In accordance with the structure described above, when the differential mechanism is locked the rod 117 moves to bring the movable contact 131 into contact with the fixed contact 133, enabling the differential lock state to be detected.

Here, since the switch apparatus 115 is attached on the side of the differential carrier 113, as illustrated in FIG. 3, the distal end portion of the switch case 123 including the rod 117 is exposed to lubricating oil inside the differential carrier 113.

For that reason, the lubricating oil enters between the rod 117 and the shaft hole 127 and infiltrates into the contact housing portion 125 which is not liquid tight sealed. Hence sludge and contaminant included in the lubricating oil stick to the movable contact 131 and the fixed contact 133 to occur a contact failure due to roughness on the surface of the contact portion.

To solve the above problem, there may be adopted a configuration in which the shaft hole 127 and the contact housing portion 125 are liquid-tightly partitioned by a diaphragm of an elastic material such as rubber, and the rod 117 is arranged to press the diaphragm so as to transmit the action of the rod 117 to the contact housing portion 125, thereby enabling a movable portion which is supporting the movable contact 131 to move, or the like.

However, in the switch apparatus 115 for detecting a differential lock state as described above, since the flange 119 of the rod 117 abuts on and engages with the rotating detecting plate 121 in the axial direction, the rod 117 rotates in an interlocking manner with the detecting plate 121 generates a sliding contact between the rod 117 and the diaphragm, which may produce a problem in that the diaphragm loses its durability in a short period of time.

The problem caused when the rod 117 receives input in the rotation direction occurs not only in detecting a rotational object as described above, but also occurs when a rod receives a torsional force as in a case where a rod is designed to engage with a cam to detect its displacement, wherein the cam surface thrusts the rod.

[Patent Document 1] Japanese Patent Application Laid-Open No. 2006-29579

[Patent Document 2] Japanese Patent Application Laid-Open No. 09-265859

The problem to be solved is that the contact housing portion being made liquid tight loses its durability.

SUMMARY OF THE INVENTION

In order to achieve the object that a contact housing portion should be kept liquid tight sealed and should have improved durability, a switch apparatus according to the present invention is mainly characterized by including: a switch case including a contact housing portion therein and a shaft hole opened to outside at one end thereof; a rod which is axially movable along the shaft hole and rotatably supported and whose outer distal end can abut on and engage with in the axial direction; an elastic member interposed between the switch case and the rod and biasing the rod in the extending and shrinking direction with respect to shaft hole; a fixed contact housed in the contact housing portion and fixed to the switch case, a movable contact which can reciprocally move between a position touching the fixed contact and a non-touching position; a diaphragm separating the shaft hole from the contact housing portion and being formed of a non-conducting material; a movable base supporting the movable contact and abutting on the diaphragm;

a return spring axially biasing the movable base toward the rod to make the movable contact touch the fixed contact or to detach the movable contact from the fixed contact to a non-contact position; and a retention member interposed between the diaphragm and the rod, including an abutting portion for abutting on the rod, and axially movably, but not rotatably supported with respect to the switch case.

The axial rotation of the rod can be absorbed by relatively rotating the rod at the abutting portion, enabling transmitting the axial movement of the rod to the diaphragm without transmitting the rotation to the diaphragm.

For this reason, the liquid tight state of the contact housing portion can be maintained by the diaphragm and the durability of the diaphragm can be prevented from wearing.

DETAILED DESCRIPTION OF THE PREFERRED EMBODIMENTS

A retention member with an abutting portion has achieved the object that the liquid tight state of the contact housing portion is maintained and durability can be improved.

Embodiment 1

Figure 1:
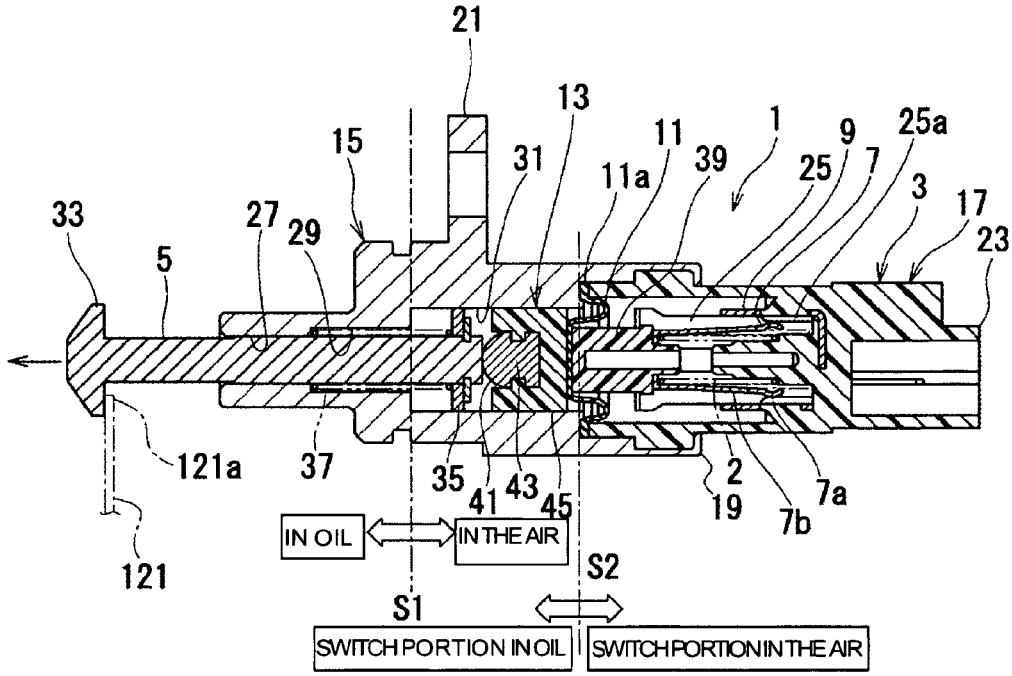
FIG. 1 is a cross section of a switch apparatus (first embodiment)
Figure 2:
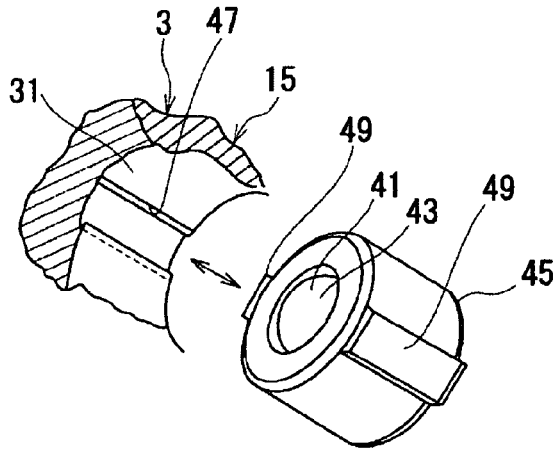
FIG. 2 is a perspective view illustrating a retention member and a part of a switch case (first embodiment)

FIG. 1 is a cross section illustrating a switch apparatus according to an embodiment of the present invention. FIG. 2 is a perspective view illustrating a retention member and a part of a switch case.

Figure 3:
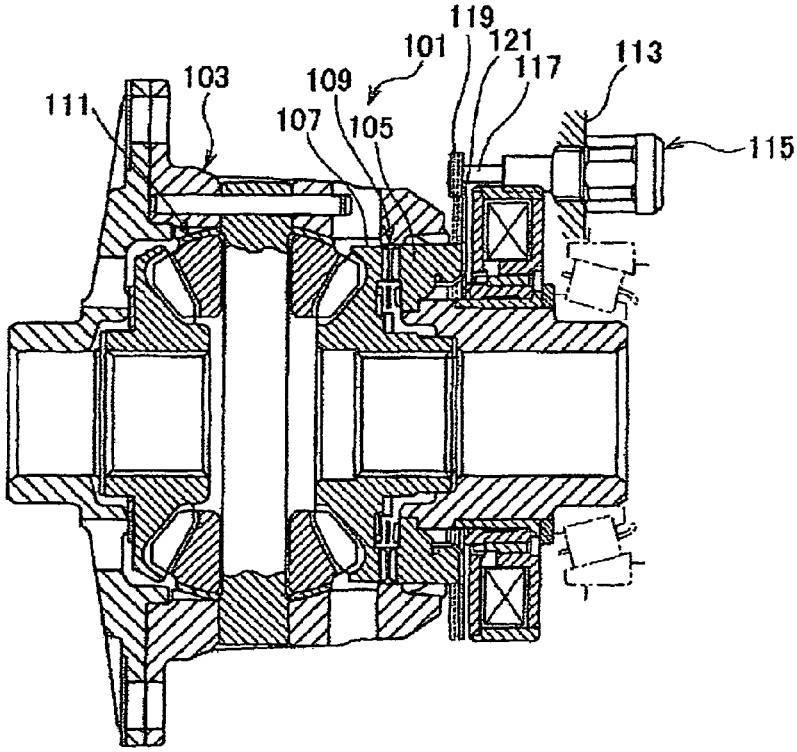
Fig.3 PRIOR ART
FIG. 3 is a cross section of a rear differential apparatus to which the switch apparatus is applied (conventional example)
Figure 4:
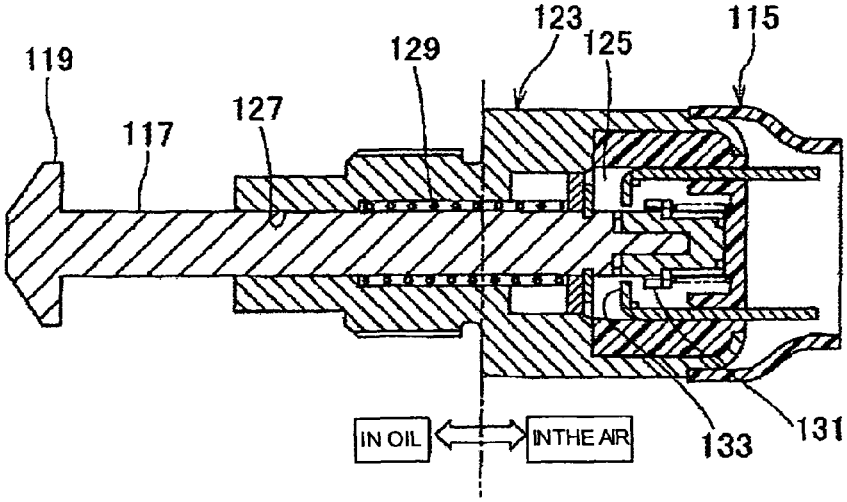
Fig.4 PRIOR ART
FIG. 4 is a cross section of the switch apparatus (conventional example).

As illustrated in FIG. 1, a switch apparatus 1 used for detecting the differential lock state is attached to the differential carrier as illustrated in FIG. 3, for example.

The switch apparatus 1 includes a switch case 3, a rod 5, a movable contact 7, a fixed contact 9, a diaphragm 11 and a retention member 13.

The switch case 3 is provided with a metallic mounting portion 15 and a resinous electrical connecting portion 17. The switch case 3 is formed such that one portion 19 of the mounting portion 15 is staked to the electrical connecting portion 17.

At the outside of the switch case 3, a flange portion 21 for coupling is provided on the mounting portion 15 and a connector portion 23 is provided on the electrical connecting portion 17.

The switch case 3 includes a contact housing portion 25 therein on the side of the electrical connecting portion 17 and a shaft hole 27 opened to the outside on the side of the mounting portion 15. A spring housing hole 29 having larger diameter than that of the shaft hole 27 is provided on the surface of the inner part of the shaft hole 27. A retention member supporting portion 31 is provided adjacent to the shaft hole 27 of the mounting portion 15.

The rod 5 is metallic, axially movable along the shaft hole 27 and rotatably supported. A flange portion 33 for engagement is provided at the outer distal end of the rod 5. The flange portion 33 is capable of axially abutting on and engaging with a periphery portion 121*a* of a detecting plate 121 being a rotation body.

A spring retainer 35 is attached to the inner end of the rod 5. A first return spring 37 as an elastic member arranged in the spring housing hole 29 elastically contacts the spring retainer 35 and biases the rod in the direction opposite to projecting direction with respect to the shaft hole 27.

The movable contact 7 and the fixed contact 9 are arranged in the contact housing portion 25.

The movable contact 7 includes a contact portion 7*a* and an arm portion 7*b*. The contact portion 7*a* is designed to contact the ramp 25*a* which is formed as a part of the electrical connecting portion 17. The arm portion 7*b* is fixed to and supported by a resinous movable base 39. A second return spring 2 is interposed between the movable base 39 and the electrical connecting portion 17 and axially biases the movable base 39 toward the rod 5.

The fixed contact 9 is fixedly attached to the electrical connecting portion 17 in a position away from the ramp 25*a* in the contact housing portion 25. The movable contact 7 can reciprocally move between a position touching the fixed contact and a non-touching position.

The diaphragm 11 is formed of rubber as one example of a non-conducting material and the outer periphery 11*a* thereof being clamped between the mounting portion 15 and the electrical connecting portion 17. The diaphragm 11 liquid-tightly separates the shaft hole 27 and the retention member supporting portion 31 from the contact housing portion 25 to prevent lubricating oil from penetrating into the contact housing portion 25. The movable base 39 abuts on the diaphragm 11.

The retention member 13 is interposed between the diaphragm 11 and the rod 5, includes a spherical portion 41 as an abutting portion for abutting on the rod 5, and is axially movably, but not rotatably supported with respect to the switch case 3.

As illustrated in FIG. 2, the retention member 13 is composed of a metallic spherical member 43 and a resinous insulator 45. The spherical member 43 includes the spherical portion 41 at its front. The insulator 45 integrally fixes the base side of the spherical member 43 by insert molding.

The retention member 13 is supported by a recess 47 and a protruding key 49 so that the retention member 13 is axially movable, but not rotatable with respect to the switch case 3. For example, a pair of the recesses 47 is formed in parallel along the axial direction, on the inner surface of the retention member supporting portion 31 of the switch case 3 and in the opposing position. A pair of the keys 49 is provided on the outer face of the insulator 45 with respect to the recesses 47. The keys 49 are fitted into the recesses 47 to enable the retention member 13 to be axially and relatively slidable with respect to the retention member supporting portion 31.

[Mounted State]

The flange portion 21 of the switch apparatus is fastened and fixed to the differential carrier by a bolt. The front side of a line S1 (or, the left side in FIG. 1) is in the environment that lubricating oil in the differential carrier splatters and the rear side (or, the right side in FIG. 1) is in the air.

The lubricating oil entering through the rod 5 and the shaft hole 27 may infiltrate to the retention member supporting portion 31 and could reach a line S2. The front side of the line S2 (or, the left side in FIG. 1) inside the switch apparatus 1 is in a oil lubricating environment and the rear side of the line S2 (or, the right side in FIG. 1) is in the air.

[Detection Operation]

When the differential mechanism is locked, the detecting plate 121 engages with the flange portion 33 of the rod 5 while moves to draw out the rod 5 from the shaft hole 27 of the switch case 3.

The drawing force, then nullifies a pressing force of the retention member 13 against the spherical portion 41, so that the second return spring 2 biases the retention member 13 and the movable base 39 to move in the same direction as the rod 5.

In conjunction with the movable base 39, the contact portion 7*a* of the movable contact 7 retreat from the ramp 25*a* and elastically contact the fixed contact 9.

The movable contact 7 is brought into contact with the fixed contact 9 to detect the differential lock state.

When the differential mechanism is unlocked, the detecting plate 121 returns to the original position and the rod 5 returns within the shaft hole 27 by the biasing force of the first return spring 37. Accrodingly, the retention member 13 and the movable base 39 make the contact portion 7*a* of the movable contact 7 to leave the fixed contact 9 and climb up on the ramp 25*a*.

The movable contact 7 moves away from the fixed contact 9, so that the differential lock state is not detected.

In such an operation, since the detecting plate 121 rotates as the differential mechanism rotates, the rod 5 may axially rotates through contact at the flange portion 33.

Even if the spherical member 43 is subjected to a rotational force, the key 49 of the insulator 45 engages with the recess 47 in the inner face of the retention member supporting portion 31 to surely prevent rotation from being transmitted to the diaphragm 11.

As a result, the axial rotation of the rod 5 is absorbed such that the end surface of the rod 5 is relatively rotated with respect to the spherical portion 41 of the spherical member 43, so that the axial rotation of the rod 5 is not transmitted to the diaphragm 11.

The lubricating oil which is splattering in the differential carrier enters a gap between the rod 5 and the shaft hole 27 and lubricates between the end face of the rod 5 and the spherical portion 41 of the spherical member 43 to smooth the relative rotation.

The rod 5 and the spherical member 43 are made of metallic material that can suppress mutual frictional wear.

A switch apparatus according to the present embodiment includes: a switch case 3 including a contact housing portion 25 therein and a shaft hole 27 opened to the outside at one end thereof; a rod 5 which is axially movable along the shaft hole 27 and rotatably supported and whose outer flange portion 33 is capable of axially abutting on and engaging with a periphery portion 121*a* of a detecting plate 121; a first return spring 37 interposed between the switch case 3 and the rod 5 wherein the first return spring is biasing the rod 5 in the direction opposite to protruding direction; a fixed contact 9 housed in the contact housing portion 25 and fixed to the switch case 3, and a movable contact 7 which can reciprocally move between a position touching the fixed contact 9 and a non-touching position; a diaphragm 11 separating the shaft hole 27 from the contact housing portion 25 and being formed of a non-conducting material; a movable base 39 supporting the movable contact 7 and abutting on the diaphragm 11; a second return spring 2 axially biasing the movable base 39 toward the side of the rod 5 to make the movable contact 7 touch the fixed contact 9; and a retention member 13 interposed between the diaphragm 11 and the rod 5, including an abutting portion 41 for abutting on the rod 5, and axially movably, but not rotatably supported with respect to the switch case 3.

For this reason, the axial rotation of the rod 5 can be absorbed by relatively rotating the rod 5 at the spherical portion 41, enabling transmitting the axial movement of the rod 5 to the diaphragm 11 without transmitting the rotation to the diaphragm 11.

In accordance with the above structure, the diaphragm can not only provide the liquid tight state of the contact housing portion but also can maintain the sate and suppress deterioration of the diaphragm durability.

The retention member 13 is composed of the metallic spherical member 43 with the spherical portion 41 and the resinous insulator 45 supporting the spherical member 43.

For this reason, it is possible to minimize the frictional wear of the spherical portion 41, wherein the frictional wear would otherwise be caused by a relative rotation between the spherical portion 41 and the rod 5.

The retention member 13, supported by the recess 47 and the key 49 which are formed in the switch case 3 and on the retention member 13 respectively to engage with each other, can be relatively slidable in the axial direction so that the retention member 13 is axially movable and not rotatable with respect to the switch case 3.

Thereby, the rotation of the retention member 13 is regulated to surely prevent rotation from being transmitted to the diaphragm 11.

The fixed contact 9 and the bump 25*a* may be reversely arranged in the axial direction to cause the second return spring 2 to bias the movable contact 7 toward the fixed contact 9 so as to bring the movable contact 7 into contact with the fixed contact 9.

The movable contact 7 may be constructed in a manner where it moves away from the fixed contact when the rod 5 is drawn out.

The retention member 13 may be supported such that a protrusion formed on the inner face of the retention member supporting portion 31 of the switch case 3 instead of the key 49 is fitted into a recess integrally formed in the outer face of the insulator 45 so that the retention member 13 is axially movable, but not rotatable with respect to the switch case 3.

The spherical portion 41 may be flat or pointed.

The switch apparatus 1 is also applicable to detection other than the differential lock detection.

The rod 5 is applicable not only for detecting the axial movement of a rotation body, but also for detecting displacement caused by the rod abutting on a cam surface to be detected.

DESCRIPTION OF SYMBOLS

1 Switch apparatus
2 Second return spring
3 Switch case
5 Rod
7 Movable contact
9 Fixed contact
11 Diaphragm
13 Retention member
41 Spherical portion
43 Spherical member
45 Insulator
47 Recess
49 Key (protrusion)

What is claimed is:

1. A switch apparatus comprising:

a switch case including a contact housing portion therein and a shaft hole opened to outside at one end thereof;

a rod which is axially movable along the shaft hole and rotatably supported and whose outer distal end can abut on and engage with in the axial direction;

an elastic member interposed between the switch case and the rod and biasing the rod in the extending and shrinking direction with respect to shaft hole;

a fixed contact housed in the contact housing portion and fixed to the switch case, and a movable contact which can reciprocally move between a position touching the fixed contact and a non-touching position;

a diaphragm separating the shaft hole from the contact housing portion and being formed of a non-conducting material;

a movable base supporting the movable contact and abutting on the diaphragm;

a return spring axially biasing the movable base toward the rod to make the movable contact touch the fixed contact or to detach the movable contact from the fixed contact to a non-contact position; and a retention member interposed between the diaphragm and the rod, including an abutting portion for abutting on the rod, and axially movably, but not rotatably supported with respect to the switch case.

2. The switch apparatus according to claim 1, wherein the retention member includes a metallic spherical member with a spherical portion and a resinous insulator supporting the spherical member.

3. The switch apparatus according to claim 1, wherein the retention member, supported by a recess and a protrusion which are formed in the switch case and on the retention member respectively to engage with each other, can be relatively slidable in the axial direction so that the retention member is axially movable, but not rotatable with respect to the switch case.

* * * * *